US005488264A

United States Patent [19]

Ota et al.

[11] Patent Number: 5,488,264

[45] Date of Patent: Jan. 30, 1996

[54] ELECTRON GUN FOR COLOR CATHODE-RAY TUBE

[75] Inventors: Yutaka Ota; Yukinobu Iguchi; Yoshifumi Nakayama, all of Kanagawa, Japan

[73] Assignee: Sony Corporation, Tokyo, Japan

[21] Appl. No.: 80,776

[22] Filed: Jun. 24, 1993

[30] Foreign Application Priority Data

Jun. 29, 1992 [JP] Japan ..... 4-170321

[51] Int. Cl.[6] ..... H01J 29/51

[52] U.S. Cl. ..... 313/412; 313/414; 313/441

[58] Field of Search ..... 313/412, 414, 313/442, 441

[56] References Cited

U.S. PATENT DOCUMENTS 4,583,024 4/1986 Chen ..... 313/414

4,614,894 9/1986 Izumida ..... 313/414

4,853,601 8/1989 Odenthal ..... 313/412 X 4,900,979 2/1990 Shimona et al. ..... 313/412

*Primary Examiner*—Sandra L. O'Shea

*Assistant Examiner*—Matthew J. Esserman

*Attorney, Agent, or Firm*—Ronald P. Kananen

[57] ABSTRACT

An electron gun for a color CRT has three cathodes disposed in parallel to each other, first to fifth grid electrodes and a convergence deflector. The electron gun is additionally provided with a tetrode magnetic field generator including a pair of permanent magnets having an astigmatic effect of the central beam of the electron gun on the cathode side of the convergence deflector. An astigmatism eliminator is provided to cancel astigmatic aberration of the side beams of the electron gun near the position where the electron beams are converged. The astigmatism eliminator is composed of a fifth grid electrode whose entrance has an electron beam passing hole of nearly elliptic shape.

7 Claims, 2 Drawing Sheets

ELECTRON GUN FOR COLOR CATHODE-RAY TUBE

BACKGROUND OF THE INVENTION

1. Field of the Invention

The present invention relates generally to an electron gun for a color CRT (Cathode-ray tube) having three cathodes disposed in parallel to each other. Particularly the present invention relates to a technique for preventing a halo phenomenon occurring on an electron beam of a CRT screen.

2. Description of the Prior Art

Generally, electron guns utilized in color CRTs utilize, for example, three cathodes, electrodes for forming a specified electric field, and a convergence deflector. The side beams of the three electron beams produced by the cathodes are converged once, disperse, and then enter the convergence deflector where the side beams are again deflected, the three beams then being focused to converge at a single point on the CRT screen.

For such three cathode electron guns, an arrangement wherein the three cathodes are disposed in parallel has been widely adopted as such an arrangement is easily constructed.

However, such parallel-cathode type electron guns have a drawback in that an astigmatic lens effect is subjected to the side beams since the side beams need to be greatly deflected. Such astigmatic lens effect causes an asymmetric halo on the CRT screen which, if left uncorrected, deteriorates the focusing characteristics of the CRT.

It has been proposed to compensate for such an astigmatic lens effect by providing a counter-astigmatic lens effect for neutralizing the negative effects on the side beams. However, provision of such a counter-astigmatic lens effect tends to deteriorate focusing characteristics of the central beam and the CRT quality is degraded.

Thus, it has been required to provide an electron gun for a color CRT having parallel-cathode construction which can eliminate a halo effect from occurring on the CRT screen and and in which optimal focusing characteristics are maintained.

SUMMARY OF THE INVENTION

It is therefore a principal object of the present invention to overcome the drawbacks of the prior art.

It is a further object of the present invention to provide an electron gun for a color CRT having parallel-cathode construction which can eliminate a halo effect from occurring on the CRT screen and and in which optimal focusing characteristics are maintained.

In order to accomplish the aforementioned and other objects, an electron gun for a color cathode ray tube is provided, comprising: first, second and third cathodes arranged horizontally parallel with each other, each of the cathodes emitting an electron beam modulated by a signal, a plurality of electrodes, each of which is supplied with a predetermined voltage and forming a predetermined electrical field for converging the three electron beams and then diverging same, a convergence plate member for converging the diverged three beams, quadruple magnetic field generating means arranged between the electrodes and convergence plate member and for effecting an astigmatic lens action to a center beam of the three beams, and astigmatic canceling means for canceling astigmatism imparted to side beams of the three beams by the electrical field and arranged around a convergence point of the electrodes.

BRIEF DESCRIPTION OF THE DRAWINGS

In the drawings:

FIG. 1(*b*) is a side view of a tetrode magnetic field generating means showing the placement of a pair of permanent magnets;

FIG. 1(*c*) is a front view of a fifth grid electrode of the electron gun according to the preferred embodiment;

FIG. 2(*b*) is a horizontal distribution diagram at the entrance to the fifth grid electrode;

FIG. 3(*b*) is a drawing illustrating an astigmatic halo state caused by an electric field generated by an astigmatism canceling means according to the preferred embodiment;

FIG. 3(*c*) is a drawing illustrating an astigmatic halo state caused by an electric field generated by the tetrode magnetic field generating means of FIG. 1(*b*); and FIG. 3(*d*) is a drawing illustrating a state where the three electron beam shapes have no resultant astigmatic halo according to the present invention.

DESCRIPTION OF THE PREFERRED EMBODIMENT

Figure 1A:
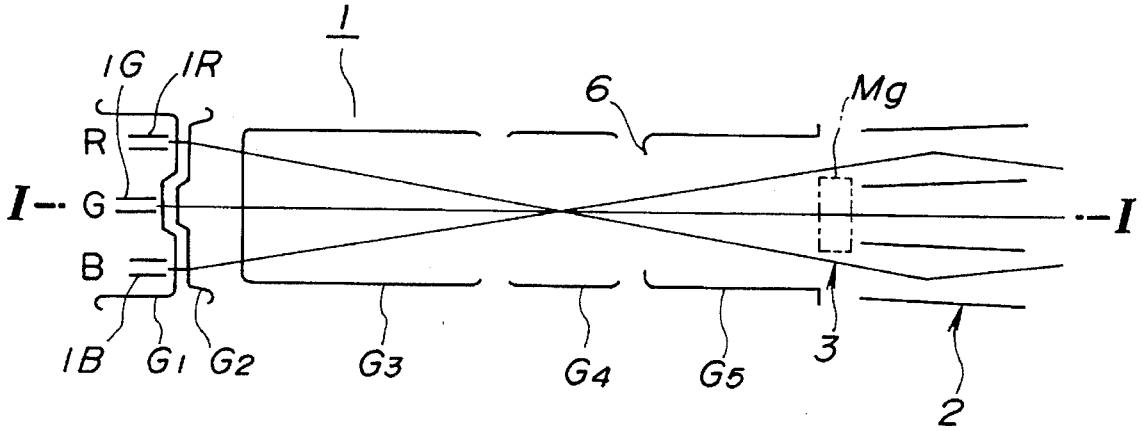
FIG. 1(*a*) is a schematic view of an electron gun for a color cathode-ray tube according to a preferred embodiment of the invention.
Figure 1B:
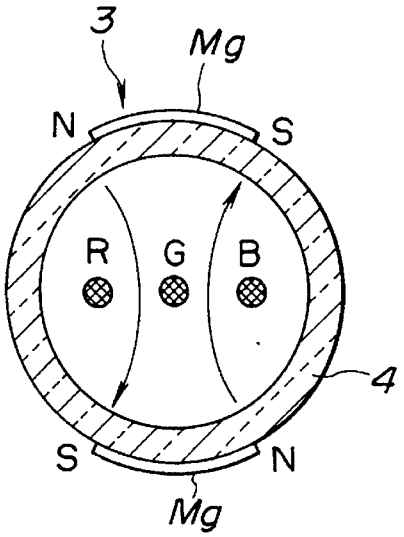
Figure 1C:
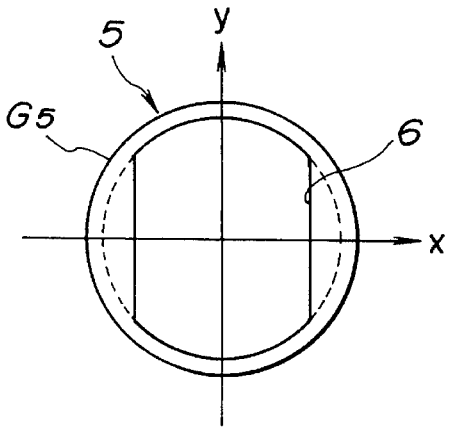
Figure 2A:
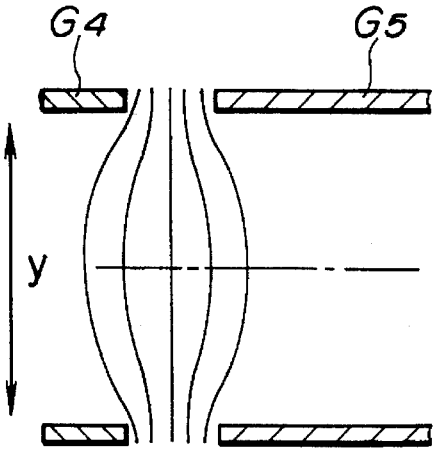
FIG. 2(*a*) is a vertical distribution diagram of the electric field at the entrance of the fifth grid electrode.
Figure 2B:
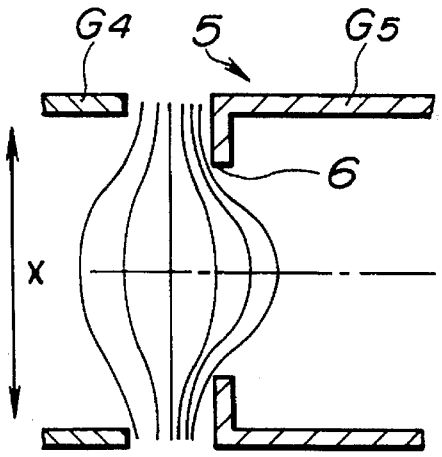
Figure 3A:
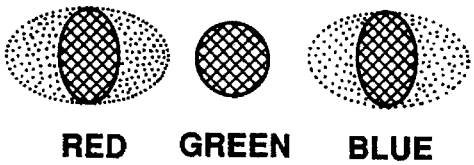
FIG. 3(*a*) is a drawing illustrating an astigmatic halo state caused by an electric field between the second and third grid electrodes.
Figure 3B:
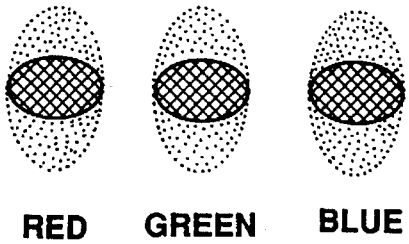
Figure 3C:
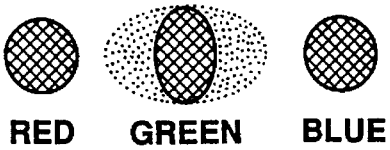
Figure 3D:
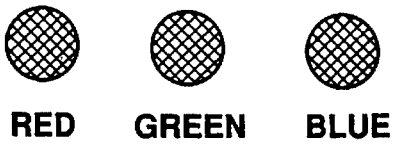

Referring now to the FIGS. 1–3, FIG. 1(*a*) shows an outline of the construction of an electron gun for a color CRT according to a preferred embodiment of the invention. In FIG. 1(*a*), three cathodes 1*r*, 1*g* and 1*b* are disposed horizontally in parallel with each other. The cathodes 1*r*, 1*g* and 1*b* respectively generate electron beams R, G and B.

First to fifth grid electrodes G1 to G5 are axially aligned at specified intervals. The first grid electrode G1 is set at an electric potential lower than the cathodes 1*r*, 1*g* and 1*b*, the second grid electrode G2 is set at a medium electric potential, the third and fifth grid electrodes G3 and G5 are set at a substantially high electric potential equal to that of an anode (not shown) of the electron 1 gun and the fourth grid electrode G4 is set at a low to medium electric potential of 0 to 400 V.

The electric potentials set in this manner make respectively specified electric fields among the electrodes G1 to G5. For example, an electric field is established between the second grid electrode G2 and the third grid electrode G3 such that the side beams (i.e. R, B) are greatly deflected toward a central axis I—I of the electron gun 1. As seen in FIG. 1(*a*), the electron beams R, G and B are once converged at a middle portion of the fourth grid electrode G4 and are then dispersed to enter into a convergence deflector 2.

The convergence deflector 2 is partitioned into three chambers and is adjusted so that the three electron beams may converge at one point on the CRT screen (not shown) by deflecting again each of the side beams which respectively enter into side chambers of the convergence deflector 2 once again toward the central axis I—I.

A tetrode magnetic field generator 3 is disposed on the front side of the convergence deflector 2. According to the present embodiment, the tetrode magnetic field generator 3 is composed of a pair of permanent magnets Mg, Mg as shown in FIG. 1(*b*). The pair of permanent magnets Mg, Mg, are disposed on upper and lower outside faces of a barrel portion 4 of the electron gun 1 and create a tetrode magnetic field inside the barrel portion 4 as shown in FIG. 1(*b*). Since the three electron beams are sufficiently separated on the front side of the convergence deflector 2, an astigmatic lens effect created by the tetrode magnetic field generator 3 hardly acts on the side beams R, B while acting intensely on the central beam G.

Astigmatism eliminator means 5 is disposed near the position where the three electron beams converge and has an astigmatic lens effect sufficient to cancel astigmatic aberration occurring in the side beams R, B. According to the present embodiment, as seen in FIG. 1(*c*), the astigmatism eliminator means 5 is incorporated in the fifth grid electrode G5 as an electron beam passing hole of vertically long and nearly elliptic shape. Thus, equipotential lines between the fourth grid electrode G4 and fifth grid electrode G5 are different in the horizontal direction (x direction) and the vertical direction (y direction) so as to be curved more sharply in the vertical (y) direction. Accordingly, a passing electron beam is affected by a concave lens effect in the horizontal (x) direction to be affected by an astigmatic lens effect in the vertical (y) direction.

The effect of the above-mentioned construction may be described as follows: the side beams R and B are deflected toward the central axis I—I under the influence of the electric field between the second grid electrode G2 and the third grid electrode G3, and, at this time they are affected by an astigmatic lens effect. The astigmatic lens effect is a tetrode lens effect showing a convex lens effect in the horizontal (x) direction and a concave lens effect in the vertical (y) direction and acts on only the side beams such that the three electron beams R, B and G show an astigmatic halo phenomenon in the horizontal (x) direction as shown in FIG. 3(*a*).

The three electron beams affected by the electric field between the second grid electrode G2 and the third grid electrode G3 are converged once inside the fourth grid electrode G4 and are then dispersed. The three electron beams then enter the fifth grid electrode G5 just after this dispersion and in the position where they are not far apart from each other and are then affected by an astigmatic lens effect in the vertical (y) direction at the entrance of the fifth grid electrode G5. Since this astigmatic lens effect acts on all three of the electron beams R, G and B, electron beam spots of the three beams R, G and B show an astigmatic halo phenomenon as shown in FIG. 3(*b*).

The three electron beams go through inside the fifth grid electrode G5 as parting gradually more and more from each other and come apart enough from each other at the exit of the fifth grid electrode G5. At the location from which the three beams R, B, and G exit the fifth grid electrode G5, they are affected by a tetrode magnetic field generated by the pair of permanent magnets Mg, Mg and are affected by an astigmatic lens effect in the horizontal (x) direction at this time. Since this astigmatic lens effect acts only on the central beam G, the R, B, and G beams now show an astigmatic halo phenomenon as shown in FIG. 3(*c*).

The three electron beams R, B and G which have passed through the tetrode magnetic field enter into the convergence deflector 2 and the side beams R and B are deflected toward the central axis I—I and the three electron beams are converged at a single point on the CRT screen (not shown). At this time, the influence of the tetrode magnetic field on the convergence is compensated.

Since the respective shapes of the three electron beams spots irradiated on the CRT screen are determined by a synergic action of the astigmatic lens effects in the above-mentioned three positions, they result in shapes showing no astigmatic halo, as shown in FIG. 3(*d*).

Further, according to the preferred embodiment, the astigmatism eliminator means 5 is set in the position of the fifth grid electrode CS, however, if it is set in the position of the fourth grid electrode G4, for example, which is the location where the three electron beams R, B and G converge, it will also act effectively.

As set forth above, the invention succeeds in preventing a halo phenomenon of an electron beam spot on a CRT screen by providing a specified tetrode magnetic field generator 3 and an astigmatism eliminator in a color CRT electron gun of parallel-cathode construction.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An electron gun for a color cathode-ray tube, comprising:

first, second and third cathodes arranged horizontally parallel with each other, each of said cathodes emitting an electron beam modulated by a signal;

a plurality of axially aligned electrodes, each of which is supplied with a predetermined voltage, forming a predetermined electrical field for converging said three electron beams to a converging spot and then diverging said three beams;

a convergence plate member for converging said diverged three beams;

quadruple magnetic field generating means arranged between said electrodes and said convergence plate member for effecting an astigmatic lens action to a center beam of said three beams without substantially effecting side beams of said three beams; and astigmatic canceling means arranged at or near said converging spot along said electrodes for canceling astigmatism imparted to said side beams of said three beams by said electrical field.

2. An electron gun as set forth in claim 1, wherein said quadruple magnetic field generating means includes a pair of permanent magnets, each of said magnets being mounted on upper and lower sides of a barrel portion of said cathode-ray tube.

3. An electron gun as set forth in claim 1, wherein said astigmatic canceling means includes means for defining an elliptic hole through which said beams are passed.

4. An electron gun as set forth in claim 3, wherein a major axis of said elliptic hole is vertically oriented.

5. An electron gun as set forth in claim 3, wherein said plurality of axially aligned electrodes comprises five axially aligned electrodes and said astigmatic canceling means is incorporated in said fifth electrode of said axially aligned electrodes.

6. An electron gun as set forth in claim 3, wherein said plurality of axially aligned electrodes comprises first through fifth axially aligned electrodes and said astigmatic canceling means is incorporated in the fourth electrode of said axially aligned electrodes.

7. An electron gun as set forth in claim 1, wherein said quadruple magnetic field generating means is disposed at a location where said electron beams enter said convergence plate member.

* * * * *